US007682291B2

(12) United States Patent
Gill et al.

(10) Patent No.: US 7,682,291 B2
(45) Date of Patent: Mar. 23, 2010

(54) OMNI-DIRECTIONAL TREADMILL

(75) Inventors: James G. Gill, Glendale, CA (US); Michael B. Harrington, Pasadena, CA (US)

(73) Assignee: Reel Efx, Inc., North Hollywood, CA (US)

( * ) Notice: Subject to any disclaimer, the term of this patent is extended or adjusted under 35 U.S.C. 154(b) by 893 days.

(21) Appl. No.: 11/438,150

(22) Filed: May 22, 2006

(65) Prior Publication Data

US 2007/0270285 A1 Nov. 22, 2007

(51) Int. Cl.
*A63B 22/02* (2006.01)

(52) U.S. Cl. ..... 482/54; 482/51

(58) Field of Classification Search ..... 482/51, 482/54; 119/700; 434/247
See application file for complete search history.

(56) References Cited

U.S. PATENT DOCUMENTS

| | | | | |
|---|---|---|---|---|
| 5,562,572 | A | 10/1996 | Carmein | |
| 6,152,854 | A | 11/2000 | Carmein | |
| 6,743,154 | B2 * | 6/2004 | Epstein | 482/54 |
| 2005/0148432 | A1 * | 7/2005 | Carmein | 482/8 |
| 2005/0266963 | A1 * | 12/2005 | Holmes | 482/54 |

* cited by examiner

*Primary Examiner*—Glenn Richman
(74) *Attorney, Agent, or Firm*—James Creighton Wray; Meera P. Narasimhan

(57) ABSTRACT

A treadmill having a belt assembly allows a user to walk or run in any arbitrary direction. A flattened flexible toroid bladder injected with a lubricant, and stretched over a frame with rotating members. Separate power-driven mechanisms concurrently rotate the toroid belt around the major and minor axis to allow omni-directional user movement.

19 Claims, 5 Drawing Sheets

OMNI-DIRECTIONAL TREADMILL

BACKGROUND OF THE INVENTION

1. Field of the Invention

The present invention relates to omni-directional treadmills; that is treadmills that allow users to walk or run in any arbitrary direction. Currently, omni-directional treadmills are mechanically complex, noisy, and expensive. A need exists for affordable, quiet omni-directional treadmills that have smooth, continuous surfaces.

2. Description of the Prior Art

U.S. Pat. No. 6,743,154 discloses an omni-directional moving surface composed of a spheroid bladder, a walking platform enveloped by that bladder, and a support base with ball-bearings. That system involves the stretching of a spheroid shape to approximate a flat surface, and does not provide means for a powered drive.

U.S. Pat. No. 6,152,854 discloses an omni-directional treadmill. Because that system has a walking surface composed of many small rotating elements, that system may be too noisy to be practical in many applications, and the smoothness of such a surface is limited.

There is a need in the art for an improved continuous, fully omni-directional motorized moving surface that can be used as a treadmill or motion simulator.

SUMMARY OF THE INVENTION

The invention described herein is similar to a linear treadmill in that the user is able to walk or run in an upright manner while remaining stationary. Alternately, the user may assume a variety of postures with respect to the planar active surface such as sitting, crawling, or lying prone.

Unlike an ordinary treadmill, the invention is omni-directional and allows users to walk or run in any arbitrary direction. The apparatus employs a flexible endless toroid belt that can be rotated around its major and minor axis simultaneously, to allow motion in any direction.

To form the toroid belt, a non-porous rubber-like material is folded around flexible rods and flattened. The flexible rods remain within position on opposite sides of the belt and act to maintain the belt's shape and alignment during use. The belt will have seams that need to be sealed using heat or a flexible adhesive. Lubricant is then injected to lubricate the interior surface of the toroid belt. This lubricant may be viscous or dry. The resulting belt is shaped like two conventional treadmill belts, placed one inside the other, with their edges joined and the space between them filled with lubricant. The belt is then looped around rollers.

The belt has two layers, inner and outer, in between which the lubricant is injected. The top portion of the belt rests on a platform that supports users' weight, and the outer layer of this portion of the belt, the user active surface, is the part of the belt that will be contacted by users. The inner layer of the top portion of the belt, the lower layer, actually rests on and slides against the platform surface, which has a low coefficient of friction, when the belt is in use.

To rotate the belt, two sets of rollers are employed; one to move the belt in the X direction and one to move the belt in the Y direction. The X-direction rollers are located along the edges of the top portion of the belt against both the active and lower surfaces. The X-direction rollers press both the active and lower surfaces of the belt against its internal flexible rods. The rollers pressed against the active surface of the belt and the rollers pressed against the lower surface rotate in the same plane, pushing the lower surface in one direction and the active surface in the opposite direction, causing the surfaces to slide against each other and roll over the rods in the desired direction. The two surfaces are able to slide against each other because of the viscous internal lubricant.

The Y-direction rollers press against the inner surface of the two ends of the belt like in a conventional linear treadmill and rotate to turn the belt in the Y direction. All of the rollers (Y-direction and X-direction) are constructed with small secondary rollers on the primary roller surfaces. The small secondary rollers freely rotate on secondary roller axles mounted circumferentially and tangentially on the primary roller surfaces. The small secondary rollers rotate in directions perpendicular to the primary rollers on which the secondary rollers are mounted.

Because of the secondary rollers, the belt can move freely in the Y direction over the X-direction primary rollers, and vice versa. The secondary rollers thus allow the belt to move in both directions simultaneously. The secondary rollers actually contact the belt surfaces and actually move the belt surfaces in the directions of the secondary roller axes when the primary rollers are turning. The secondary rollers passively allow movement of the belt surfaces in directions perpendicular to the secondary roller axes. Combinations of the passive and active motions of the secondary rollers while all of the primary rollers are rotating produce the angular vectors of motion on the user active surface of the belt.

The invention provides an omni-directional moving belt apparatus for allowing a user to walk or run in any arbitrary direction. The invention includes a frame and a belt assembly mounted around the frame and has an active user surface on the top of the frame. The belt assembly has a flattened toroid-shape belt made of flexible, durable, non-porous material with internal flexible rods and injected with lubricant. The invention also includes a plurality of motorized rollers that rotate the toroid-shape belt assembly around major and minor axes. The combined movement of the rotation of the belt assembly around the major and minor axes results in omni-directional movement of the user active surface of the belt assembly.

Each of the motorized rollers has a primary central roller and plural small, secondary rollers mounted on axes perpendicular to an axis of the primary roller. On each primary roller, the secondary rollers are mounted on secondary axes arranged tangentially and space circumferentially around the outer surface of the primary roller. The rollers mounted on the sides of the belt assembly are X-direction rollers and trap the internal flexible rods along the edges of the belt assembly for lateral stability of the belt assembly and to rotate the belt assembly across the flexible rods.

The invention also provides a closed-loop motor control system integrated with a user position sensing device and connected to motorized rollers that automatically keeps the user centered on the belt assembly.

The invention provides a programmable motor control system connected to the motorized rollers to allow pre-programming and repeated playback of various motion routines.

The invention also provides a motion platform on which the entire treadmill is mounted to create various angular motions and positions of the treadmill.

The invention additionally provides for a smooth coloration of the apparatus such that it can be used in "Bluescreen" (Chroma-Key) applications.

A new omni-directional treadmill method provides a frame having a longitudinal Y direction and lateral X direction, provides sets of Y-direction motorized primary rollers at longitudinal ends of the frame, and provides upper and lower X-direction motorized primary rollers on opposite sides of the top of the frame. Secondary rollers are mounted on perpendicular tangential secondary axes spaced circumferentially along outer surfaces of the primary rollers. Laterally spaced flexible circular rods are provided in a toroidal tube, the tube is flattened, closed, and sealed, and then lubricant is injected into the tube.

The flattened toroidal tube is mounted on the frame around the Y-direction rollers, the flexible circular rods are positioned in lateral extremities of the tube, and the rods and lateral extremities are captured above the frame between the upper and lower X-direction rollers. The motorized primary rollers are rotated and the belt is moved with the secondary rollers in directions of the secondary axles when the primary rollers are rotated. The belt is allowed to move freely over the secondary rollers in directions perpendicular to the secondary axles.

These and further and other objects and features of the invention are apparent in the disclosure, which includes the above and ongoing written specification, with the drawings.

DETAILED DESCRIPTION OF THE DRAWINGS

In order for a treadmill surface to move in any direction, it must have two perpendicular vector motion components, plus and minus X, and plus and minus Y. A controlled combination of these motion vectors creates a sum vector that can create surface movement in any direction. The omni-directional treadmill (ODT) used a flattened toroid belt as the active surface, and uses motorized wheel assemblies to rotate the belt around the minor axis for X direction movement, and around the Y axis for Y direction movement. The motors may be controlled with a manual or computer operated speed controller.

The toroid belt must be fabricated from a material flexible enough to be folded in the desired shape, yet durable enough to walk or run on while resisting wear. The material should be non-porous so that it can contain internal lubricant. A rubber-like polymer about ¼" thick would be an example of such a material.

Figure 1:
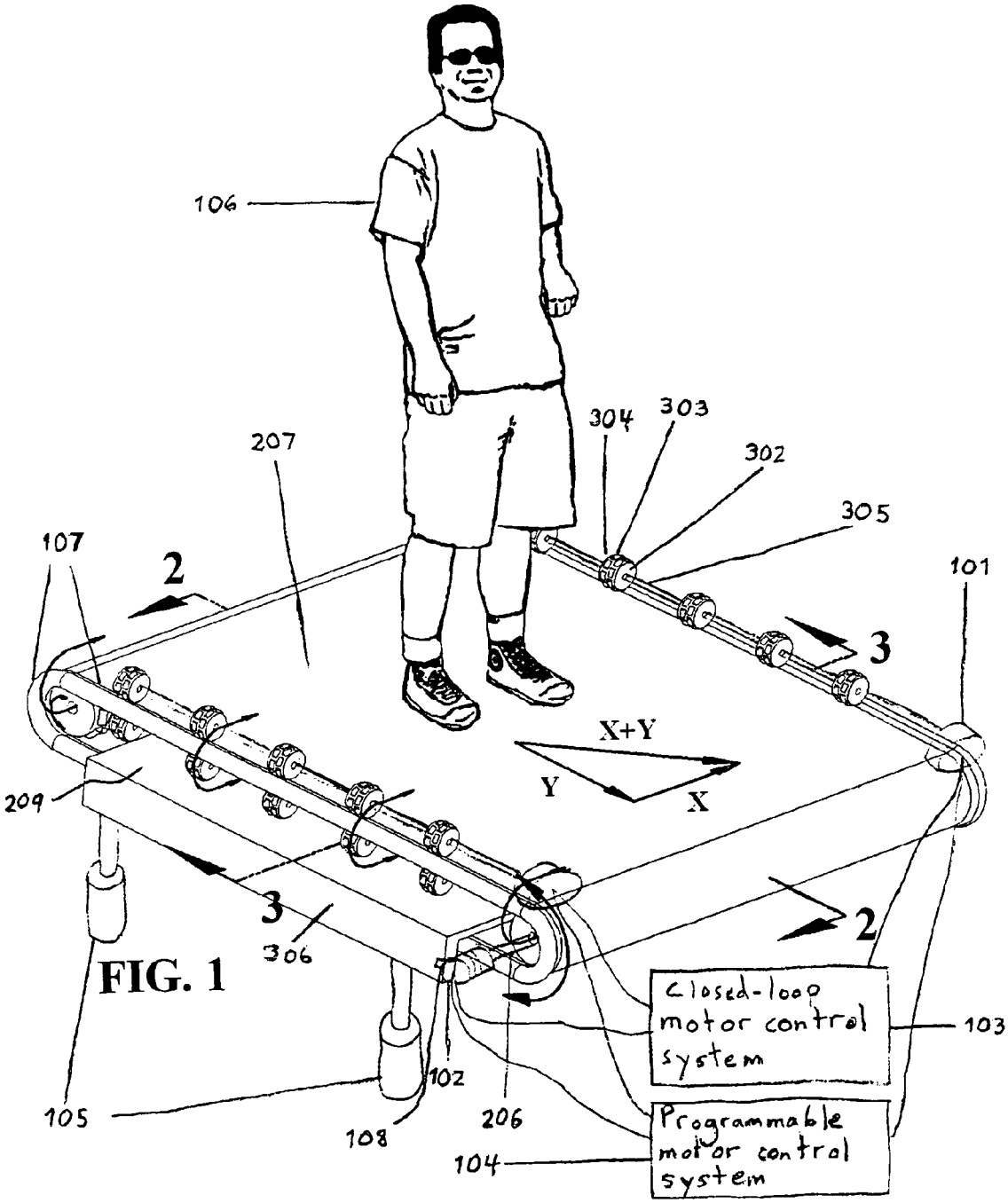
FIG. 1 is a perspective view of the conveyor assembly.

FIG. 1 illustrates the conveyer assembly from a perspective view. It shows the finished toroid conveyer belt 207 looped over the Y-direction rollers 208 and drive shaft 206, mounted on a motion platform 209, with the X-direction rollers 302 and driveshaft 305 in place. X-direction motion of the toroid belt 207 is driven by the X-direction motors 101. Y-direction motion of the belt is driven by the Y-direction motor 102. The Y-direction motion is achieved by looping the belt 207 over the two roller shafts 206, similar to those found in a conventional linear treadmill. One or both of these end roller shafts 206 are powered.

FIG. 1 also shows the axis used, with the major axis labeled Y and the minor axis labeled X, and illustrates the directions in which each set of rollers can rotate. The flexible rods push the belt outwards, creating the raised edge portions of the belt 107.

A closed-loop motor control system 103 integrated with a sensing device may be added to automatically keep the user 106 centered on the treadmill 207. Many applications, such as "Virtual Reality" (VR) simulations, as well as all manner of Video Games, would benefit from such an arrangement.

A programmable motor control system 104 may be added to allow the pre-programming and repeated playback of various motion routines. This arrangement could be especially useful for applications in the film industry, where the same user movement may need to be accurately repeated over several takes.

The entire treadmill mechanism may be mounted to a motion platform 209 to allow various angular motions and positions of the treadmill. Tipping the surface with actuators 105 would be useful for simulating inclined terrain, such as the side of a hill. The Y-direction motor 102 is mounted to the motion platform 209 with a mounting bracket 108 and moves freely with the platform 209.

A useful application for an omni-directional treadmill ("ODT") would be for use in "Bluescreen" (Chroma-Key) effects for the film industry. The Bluescreen technique involves shooting foreground action against an evenly-lit monochromatic background (usually blue or green) for the purpose of removing the background from the scene and replacing it with a different image or scene. Often, use of this technique is limited by the size of the monochromatic background, which is usually a single curtain or wall, and never larger than the size of a studio sound stage. If the action for a scene called for an actor to run or walk great distances against an alien landscape, for example, the action would normally be confined to the dimensions of the monochromatic background. If the actor were on an ODT that was the same color as the background, the action could take place while the actor remained in a relatively small area in front of the monochromatic background. The continuous surface of the toroid-belt ODT lends itself to smooth coloration that would be difficult to achieve with other ODT designs in which the surface is composed of many moving parts.

Figure 2:
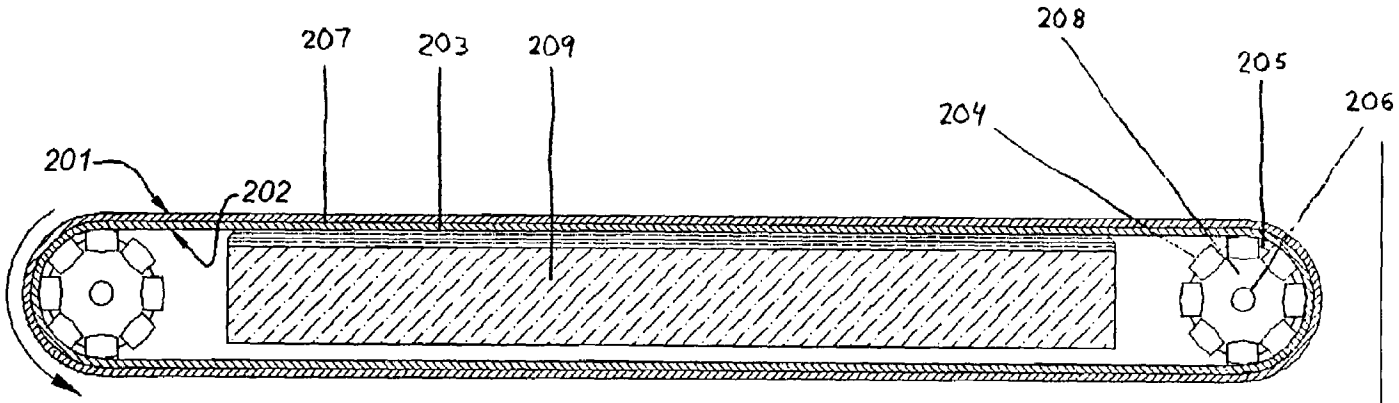
FIG. 2 is a longitudinal section view of the conveyor assembly.

FIG. 2 illustrates a cross-section of the conveyer belt assembly from a longitudinal view. The toroid belt 207 is pressed against the Y-direction roller assemblies 208, and turns with the wheel bodies 205 when they are rotated. The lower layer 202 and active layer 201 of the belt 207 are separated by lubricant and rest on the flat surface 203 of the motion platform 209, which supports the weight of users. When the belt is in motion, the underside of the belt slides on the flat platform surface 203, which has a low coefficient of friction.

Figure 3:
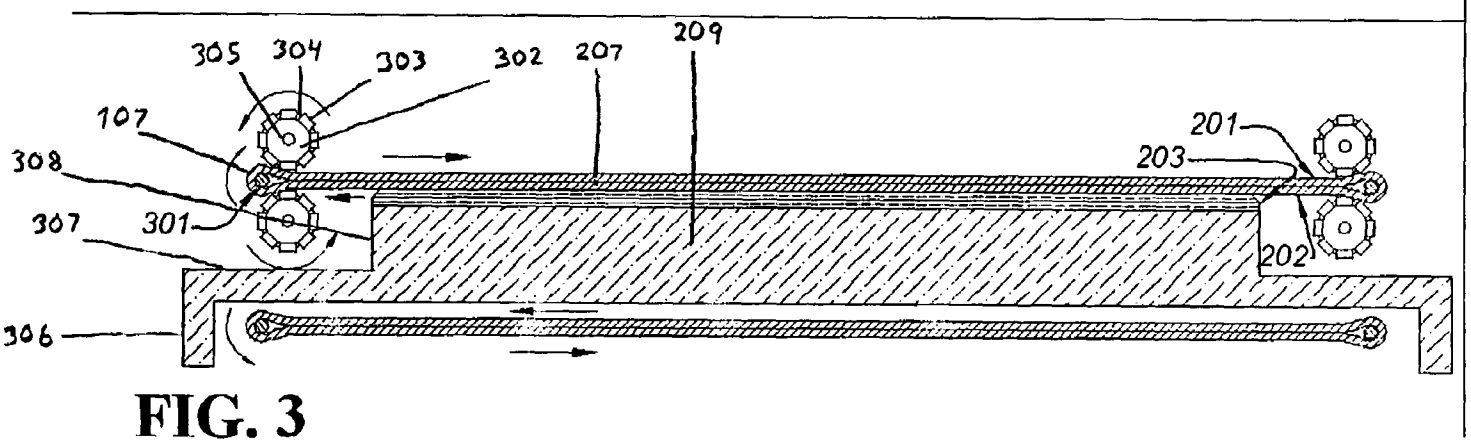
FIG. 3 is a lateral section view of the conveyor assembly.

FIG. 3 illustrates a cross-section of the conveyer belt assembly from a latitudinal view. The flexible rods 301 inside of the toroid belt 207 create the raised edge portions of the belt 107 and help the X-direction roller wheel assemblies 302 to capture the edges of the belt 207. The rods 301 roll with X-direction movement, and also serve to transmit torque evenly along the edges of the belt 207. The X-direction roller wheel assemblies 302 squeeze the belt against the rods 301, and rotate to move the active surface 201 counter to the lower surface 202. The motion of the X-rollers 302 is synchronized, either electronically or through mechanical linkages. The internal surfaces of the belt are lubricated with either a dry or viscous lubricant. FIG. 3 also shows how the belt surfaces 201 and 202 will move when the minor-axis rollers 302 rotate in a given direction.

The belt 207 rests on the flat surface 203 on the motion platform 209. The platform has a concavity 308 that allows for the mounting of the X-direction rollers. The platform extension 307 leads to a flange 306 which can be mounted on a frame, actuators, or a surface.

Figure 4A:
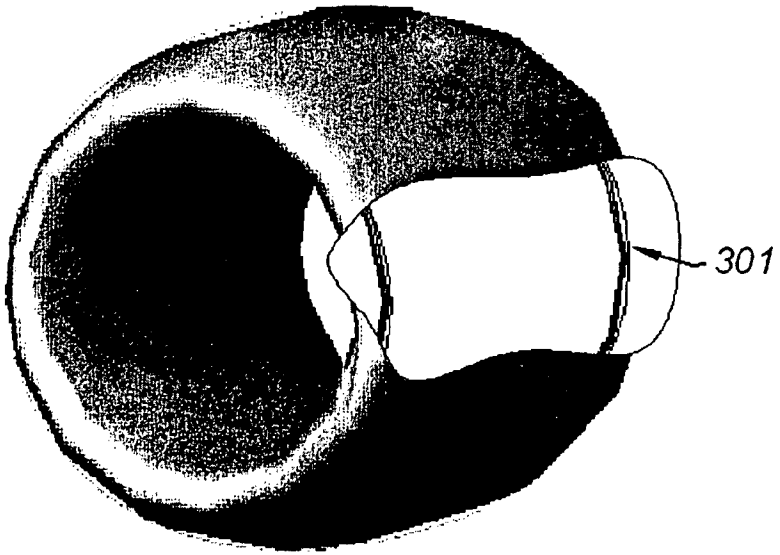
FIGS. 4A-C are diagrams showing the process of forming a flat toroid belt.
Figure 4B:
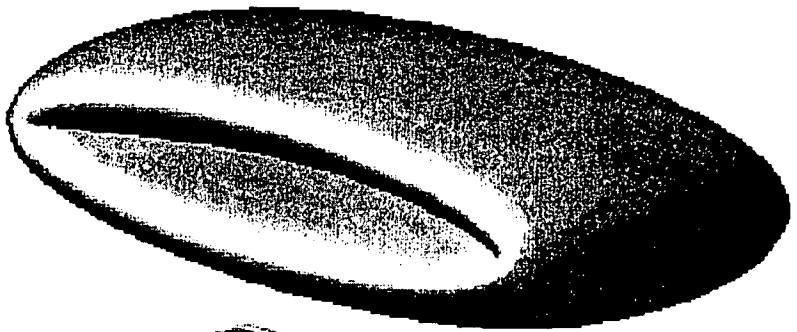
Figure 4C:
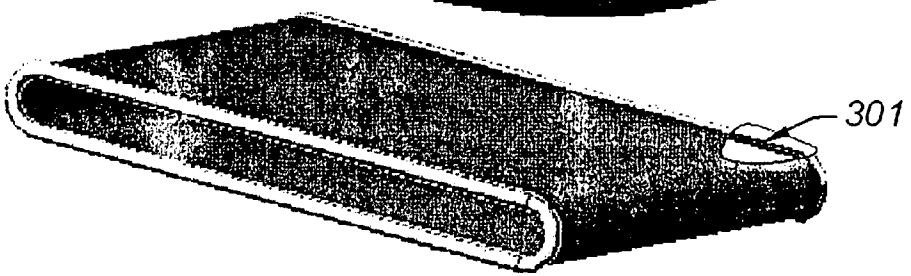

FIG. 4 illustrates the formation of an enclosed toroid shape for use as the conveyer belt 207. To form an enclosed toroid shape, the material will be folded around the flexible rods 301. The belt will have seams that need to be sealed using heat or a flexible adhesive. A dry or viscous lubricant is then injected to lubricate the interior surface of the toroid.

Figure 5:
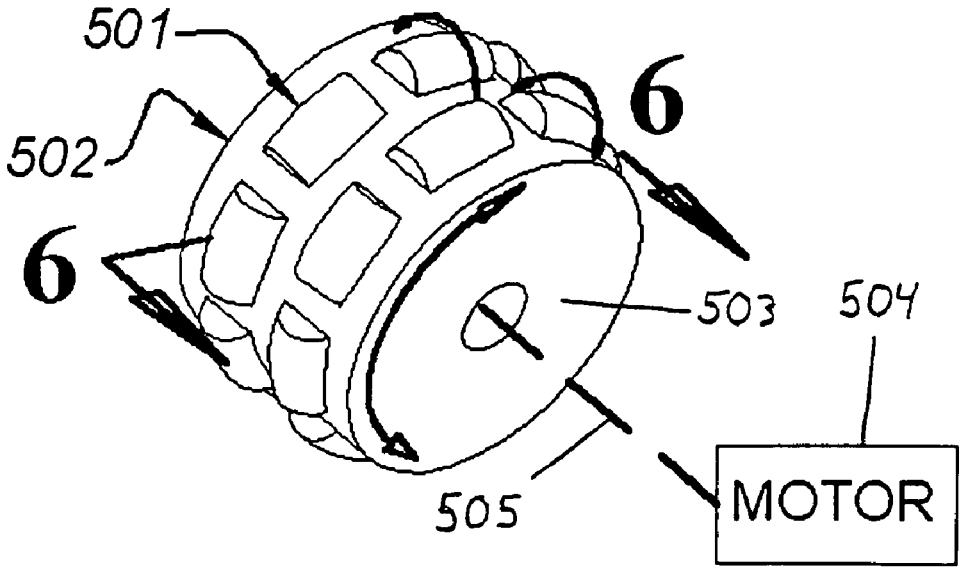
FIG. 5 is a perspective view of a typical uni-directional conveyor wheel assembly.

FIG. 5 illustrates the belt roller assemblies 503, which are designed to transmit force in a direction normal to the roller drive shaft 505, while allowing unrestricted motion in the direction parallel to the roller drive shaft 505. The assemblies 503 consist of free-turning rollers 501 positioned around the periphery of the wheel body 502. The free-turning rollers 501 are angled 90 degrees from the roller drive shaft 505, driven by a motor 504. Each roller 501 frictionally abuts the surface of the toroid belt 207.

Figure 6:
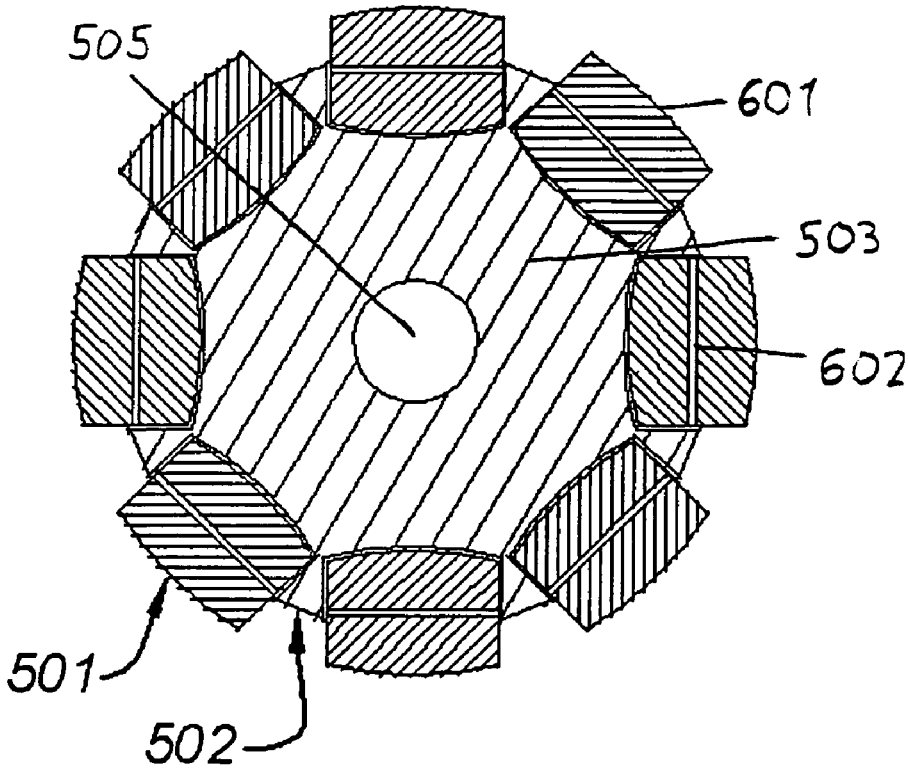
FIG. 6 is a cross-section of a conveyor wheel assembly.

FIG. 6 shows that each of the small rollers 501 has a curved surface 601 and is mounted on an axis 602 that is perpendicular to the roller drive shaft 505.

If the X-direction motors 101 are moving, and the Y-direction motor 102 remains stationary, the X-direction roller wheel assemblies 302 will rotate, with the small rollers 303 stationary within the wheel bodies 304, while the Y-direction small rollers 204 will free-spin within their stationary wheel bodies 205, creating surface movement only in the X direction. Conversely, if the Y-direction motor 102 is moving, and the X-direction motors 101 remain stationary, the Y-direction roller wheel assemblies 208 will rotate while the X-direction small rollers 303 will free-spin within their stationary wheel bodies 304, creating surface movement only in the Y direction. Movement in any direction other than pure X or pure Y will involve a combination of both types of wheel assembly movements.

Figure 7:
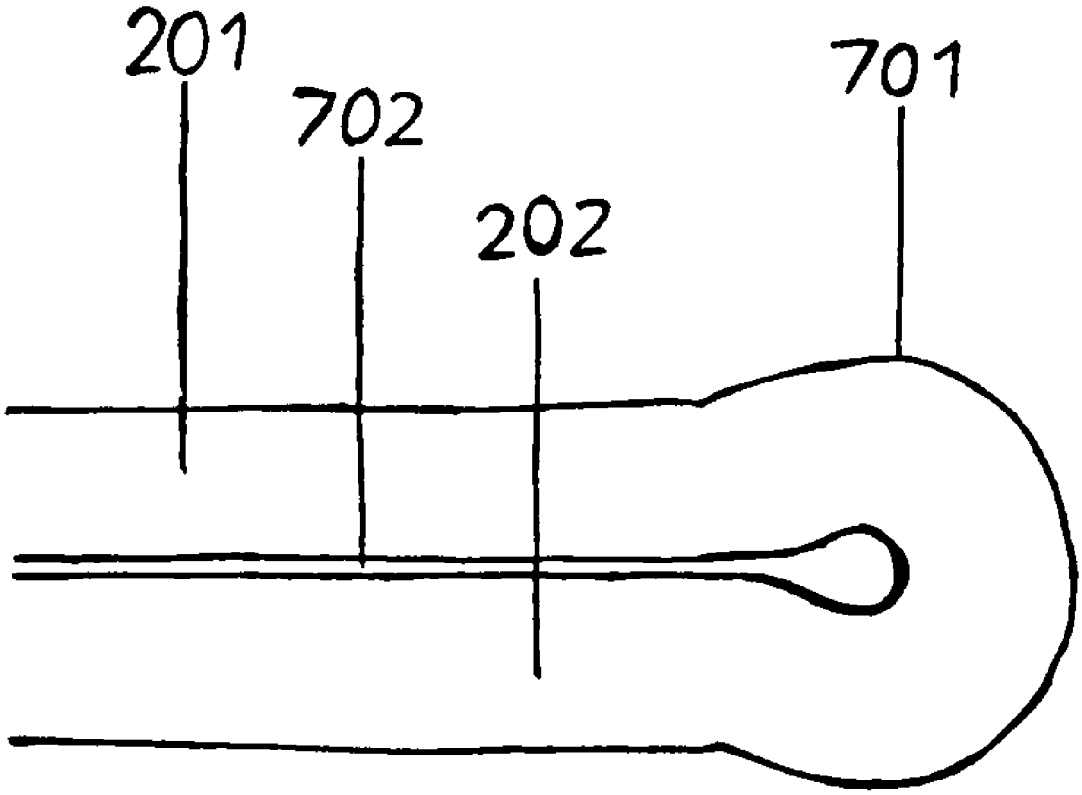
FIG. 7 is a cross-section of a toroid belt without internal rods

FIG. 7 illustrates an alternate belt assembly without internal flexible rods. Here the active layer 201 and lower layer 202 of the toroidal belt have a thin layer of lubricant 702. The belt has a minimum bending radius and bulges outward where folded at the lateral edge of the belt, forming the minimum radius bend 701. The minimum radius of this bend is sufficiently large that the belt is trapped and rotated by the X-direction rollers 302.

While the invention has been described with reference to specific embodiments, modifications and variations of the invention may be constructed without departing from the scope of the invention.

We claim:

1. A moving belt apparatus for allowing a user to walk or run in any arbitrary direction comprising: a frame, a belt assembly mounted on the frame, said belt assembly having a user active surface, wherein said belt assembly is composed of a flattened toroid shape, a plurality of motorized rollers that rotate the toroid-shaped belt around major and minor axes, whereby the combined movement of the rotation of the belt around the major and minor axes results in omni-directional movement of the user active surface of the belt, wherein the belt assembly has flexible internal rods along the sides of the belt assembly, wherein the rollers further comprise X-direction rollers mounted on the sides of the belt assembly, wherein the X-direction rollers trap the internal flexible rods along the edges of the belt assembly for lateral stability of the belt assembly and to rotate the belt assembly across the flexible rods in the X-direction.

2. The moving belt apparatus of claim 1, wherein the toroid-shaped belt is made of a flexible, durable, non-porous material.

3. The moving belt apparatus of claim 1, wherein the belt assembly is injected with lubricant.

4. A moving belt apparatus for allowing a user to walk or run in any arbitrary direction comprising: a frame, a belt assembly mounted on the frame, said belt assembly having a user active surface, wherein said belt assembly is composed of a flattened toroid shape, a plurality of motorized rollers that rotate the toroid-shaped belt around major and minor axes, whereby the combined movement of the rotation of the belt around the major and minor axes results in omni-directional movement of the user active surface of the belt, wherein the rollers further comprise X-direction rollers mounted on the sides of the belt assembly, wherein the X-direction rollers press the layers of the belt assembly against each other and turn to slide the belt assembly layers across each other and rotate the belt assembly in the X-direction.

5. The moving belt apparatus of claim 1, wherein the belt material has a suficient bend radius along lateral edges that it is trapped by the X-direction rollers.

6. The moving belt apparatus of claim 1, wherein each of the rollers has a primary central roller, and plural small, secondary rollers mounted on axes perpendicular to an axis of the primary roller.

7. The moving belt apparatus of claim 6, wherein on each roller, the secondary rollers are mounted on secondary axes arranged tangentially and spaced circumferentially around an outer surface of the primary roller.

8. The moving belt apparatus of claim 1, further comprising a closed-loop motor control system integrated with a user position sensing device and connected to the motorized rollers automatically keeps the user centered on the belt assembly.

9. The moving belt apparatus of claim 1, further comprising a programmable motor control system connected to the motorized rollers to allow pre-programming and repeated playback of various motion routines.

10. The moving belt apparatus of claim 1, wherein the entire treadmill is mounted on a motion platform to create various angular motions and positions of the treadmill.

11. The moving belt apparatus of claim 1, wherein the apparatus is smoothly colored such that it can be used in "Bluescreen" (Chroma-Key) applications.

12. A moving belt apparatus for allowing a user to walk or run in any arbitrary direction comprising:

a frame, a belt assembly mounted around the frame, said belt assembly having a user active surface, wherein said belt assembly is further comprised of a flattened toroid-shape belt, wherein said toroid-shape belt is made of a flexible, durable, non-porous material, said belt assembly is injected with lubricant, a plurality of motorized rollers that rotate the toroid-shaped belt assembly around major and minor axes, whereby the combined movement of the rotation of the belt assembly around the major and minor axes results in omni-directional movement of the user active surface of the belt assembly, wherein each of the rollers has a primary central roller, and plural small, secondary rollers mounted on axes perpendicular to an axis of the primary roller, wherein on each roller, the secondary rollers are mounted on secondary axes arranged tangentially and spaced circumferentially around an outer surface of the primary roller, wherein the rollers further comprise X-direction rollers mounted on the sides of the belt assembly, wherein the belt material has a sufficiently large minimum bend radius that the belt can be trapped by the X-direction rollers, wherein the X-direction rollers press the layers of the belt assembly against each other and turn to slide the belt assembly layers across each other and rotate the belt assembly.

13. The moving belt assembly of claim 12, wherein the belt assembly has internal flexible rods and the X-direction rollers trap the internal flexible rods along the edges of the belt assembly for lateral stability of the belt assembly and to rotate the belt assembly across the flexible rods in the X-direction.

14. The moving belt apparatus of claim 12, further comprising a closed-loop motor control system integrated with a user position sensing device and connected to the motorized rollers automatically keeps the user centered on the belt assembly.

15. The moving belt apparatus of claim 12, further comprising a programmable motor control system connected to the motorized rollers to allow pre-programming and repeated playback of various motion routines.

16. The moving belt apparatus of claim 12, wherein the entire treadmill is mounted on a motion platform to create various angular motions and positions of the treadmill.

17. The moving belt apparatus of claim 12, wherein the apparatus is smoothly colored such that it can be used in "Bluescreen" (Chroma-Key) applications.

18. An omni-directional treadmill method comprising:

providing a frame having a longitudinal Y direction and a lateral X direction, providing sets of Y-direction motorized primary rollers at longitudinal ends of the frame, providing upper and lower X-direction motorized primary rollers on opposite sides of a top of the frame, providing secondary rollers mounted on perpendicular tangential secondary axles spaced circumferentially along outer surfaces of the primary rollers, providing a toroidal tube, flattening the tube, closing and sealing the tube, injecting lubricant in the tube, mounting the flattened toroidal tube on the frame around the Y-direction rollers, capturing the lateral extremities of the flattened tube above the frame between the upper and lower X-direction rollers, rotating the motorized primary rollers and moving the belt with the secondary rollers in directions of the secondary axles when the primary rollers are rotated and allowing free movement of the belt over the secondary rollers in directions perpendicular to the secondary axles.

19. The omni-directional treadmill method of claim 18, further comprising providing laterally spaced flexible circular rods in the toroidal tube, flattening the flexible circular rods with the tube and positioning the flattened flexible circular rods in lateral extremities of the flattened tube, and trapping the rods in the lateral extremities of the flattened tube between the upper and lower X-direction rollers.

* * * * *

UNITED STATES PATENT AND TRADEMARK OFFICE

CERTIFICATE OF CORRECTION

PATENT NO. : 7,682,291 B2
APPLICATION NO. : 11/438150
DATED : March 23, 2010
INVENTOR(S) : James G. Gill and Michael B. Harrington It is certified that error appears in the above-identified patent and that said Letters Patent is hereby corrected as shown below:

Column 6, line 20 (i.e. claim 5, line 1), change:

"1" to --4--

Signed and Sealed this

Eighteenth Day of May, 2010

David J. Kappos

David J. Kappos
*Director of the United States Patent and Trademark Office*